US005153414A

United States Patent [19]

Wilson et al.

[11] Patent Number: 5,153,414

[45] Date of Patent: Oct. 6, 1992

[54] SPIDER BRACKET

[75] Inventors: Alfred H. R. Wilson, Beeton; Randall W. Brown, Richmond Hill; John E. R. Brown, Newmarket, all of Canada

[73] Assignee: Precision Components (Richmond Hill) Limited, Ontario, Canada

[21] Appl. No.: 797,652

[22] Filed: Nov. 25, 1991

[51] Int. Cl.[5] ..... H05B 3/76

[52] U.S. Cl. ..... 219/467; 219/455; 219/463

[58] Field of Search ..... 219/464, 455, 458, 463, 219/451, 467, 462

[56] References Cited

U.S. PATENT DOCUMENTS

| | | | |
|---|---|---|---|
| 2,877,334 | 3/1959 | McOrlly | 219/463 |
| 2,938,989 | 5/1960 | Smith | 219/463 |
| 2,957,068 | 10/1960 | Hanson | 219/463 |
| 3,002,079 | 9/1961 | Smith | 219/451 |
| 3,016,445 | 1/1962 | Lien | 219/451 |
| 3,327,966 | 6/1967 | Jasionowski | 219/455 |
| 4,388,518 | 6/1983 | Willbanks | 219/455 |

*Primary Examiner*—Teresa J. Walberg

*Attorney, Agent, or Firm*—Jeffrey T. Imai; Arne I. Fors

[57] ABSTRACT

A spider bracket includes a plurality of arms defining a planar surface and adapted to abut with the coiled section of a heater element and a crimp bracket extending from the arms. The crimp bracket has a plate extending substantially perpendicular to the planar surface and having a plurality of crimp members extending substantially perpendicular to the plate in opposite directions thereof. The crimp members have a substantially U-shaped configuration for receiving the ends of the element. The crimp members have a single crimp arm and a positioning arm whereby upon presenting the lower planar surface of the element to the arms and at to the ends of the crimp member, crimping the crimp arm about the end of the heater element, the planar surface of the arms is substantially coplanar with the lower surface of the element.

5 Claims, 4 Drawing Sheets

FIG. 3.
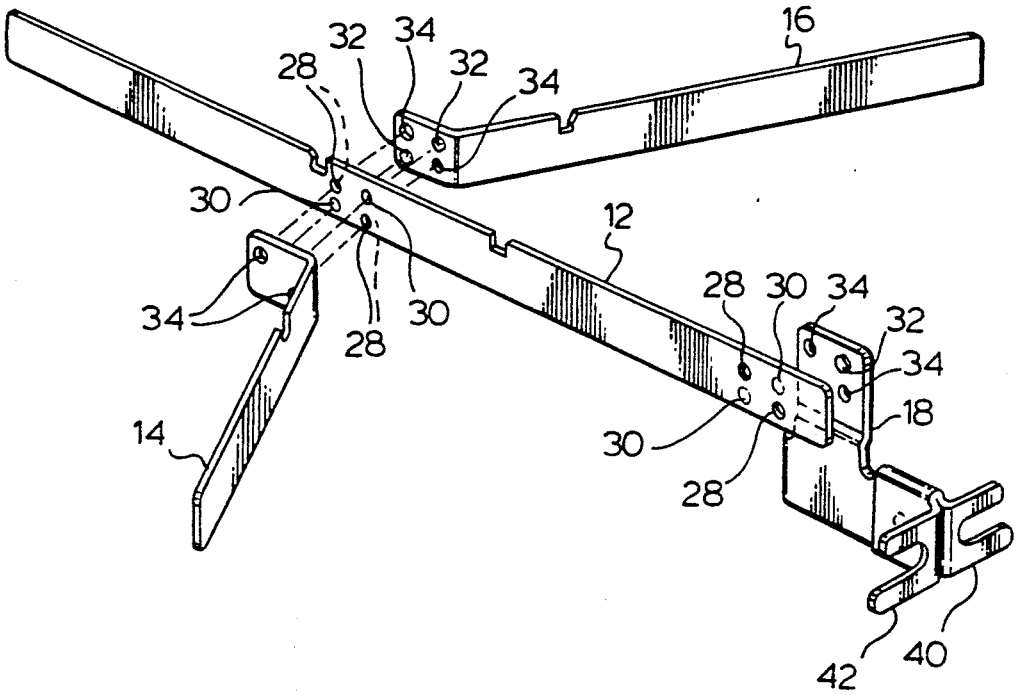
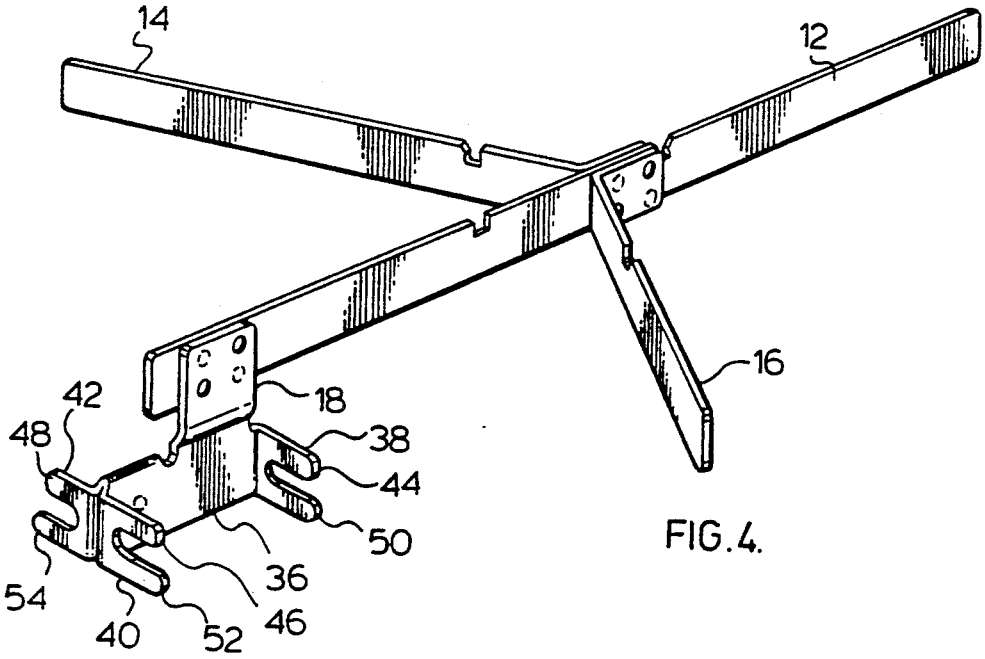
FIG. 4.

SPIDER BRACKET

FIELD OF INVENTION

This invention relates to a spider bracket for retaining and supporting an appliance heating element. In particular, the invention relates to a novel bracket which when assembled fully supports the heating element and is adapted to guide the element into a housing for final assembly of a stove.

BACKGROUND OF INVENTION

In the manufacturing and assembly of stove heating elements, the heating element is supported by a spider bracket which retains the ends of the heating elements in a substantially parallel spaced relation. The spider bracket generally comprises a support bracket and a crimp bracket which are joined together. The support bracket comprises a plurality of arms presenting a substantially planar surface. The heating element generally comprises a spiral or coiled section. The two ends of the heating element are configured to extend substantially parallel to each other below the heating element surface. The crimp bracket extends below the support bracket for retaining the ends of the heating element in a substantially parallel spaced relation.

In known prior art crimping brackets, as illustrated in FIG. 1, the bracket generally comprises a plate extending substantially parallel to the plane presented by the two ends of the heating element. Extending therebelow are a plurality of crimping arms which when constructed present a substantially inverted U-shape. The crimp bracket is manufactured from a single piece of sheet metal which is stamped and bent to the requisite size and configuration.

For assembly of the heating element with the prior art bracket as a sub-assembly, the heating element is placed on the support bracket with the ends extending therebelow. The ends of the heating element are presented into the U-shape presented by the crimping arms. The arms are then crimped about the ends of the respective heating element fully securing the heating element onto the spider bracket. The sub-assembly may be then further assembled into a housing comprising a pan and an electrical receptacle for receiving the ends of the element. The final sub-assembly is then delivered to a manufacturer of ovens and stove appliances where the final assembly takes place.

In general the prior art spider brackets are satisfactory to support the heating element. However, when crimping both arms of the crimping arms, the crimp brackets do not uniformly bend causing either the crimp bracket to distort or the heating element to distort. In either case, the result is unsatisfactory. The heating element does not properly rest upon all arms of the spider bracket. The result is that when a pot or pan is placed on the element, it will cause the element "clack" or vibrate. As a result, manufacturers of stoves and ovens will reject sub-assemblies delivered having this defect.

SUMMARY OF THE INVENTION

The disadvantages of the prior art may be overcome by providing a spider bracket which is adapted to be uniformly crimped about the ends of the heating element without distorting the heating element or the spider bracket.

According to one aspect of the invention, there is provided a spider bracket for retaining an electrical heater element. The heater element comprises a coiled section presenting an upper and lower planar surface and having two ends thereof extending substantially parallel to each other for presenting to a receptacle for electrically connecting the element. The bracket comprises a plurality of arms defining a planar surface and adapted to abut with the coiled section of the element and a crimp bracket extending from the arms. The crimp bracket has a plate extending substantially perpendicular to the planar surface and having a plurality of crimp members extending substantially perpendicular to the plate in opposite directions thereof. The crimp members have a substantially U-shaped configuration for receiving the ends of the element. The crimp members have a single crimp arm and a positioning arm whereby upon presenting the lower planar surface of the element to the arms and at to the ends of the crimp member, crimping the crimp arm about the end of the heater element, the planar surface of the arms is substantially coplanar with the lower surface of the element.

DETAILED DESCRIPTION OF THE DRAWINGS

In drawings which illustrate embodiments of the invention,

FIG. 3 is an exploded perspective view of the spider bracket of the embodiment of FIG. 2;

FIG. 4 is a perspective view of an assembled spider bracket of the embodiment of FIG. 2;

DETAILED DESCRIPTION OF THE INVENTION

Figure 1:
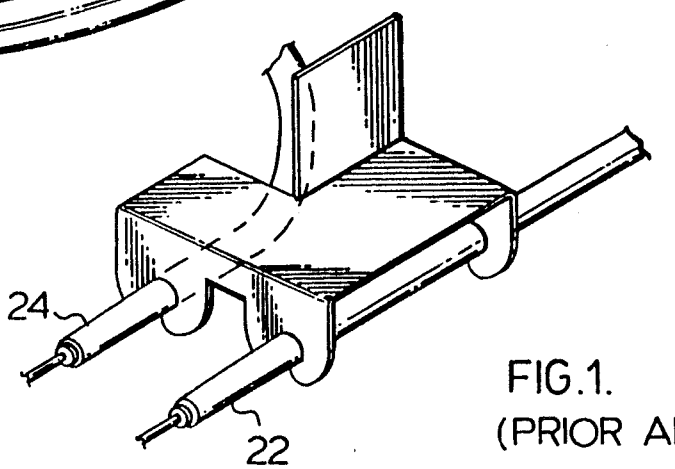
FIG. 1. (PRIOR ART)
FIG. 1 is a an illustration of a prior art spider bracket.
Figure 2:
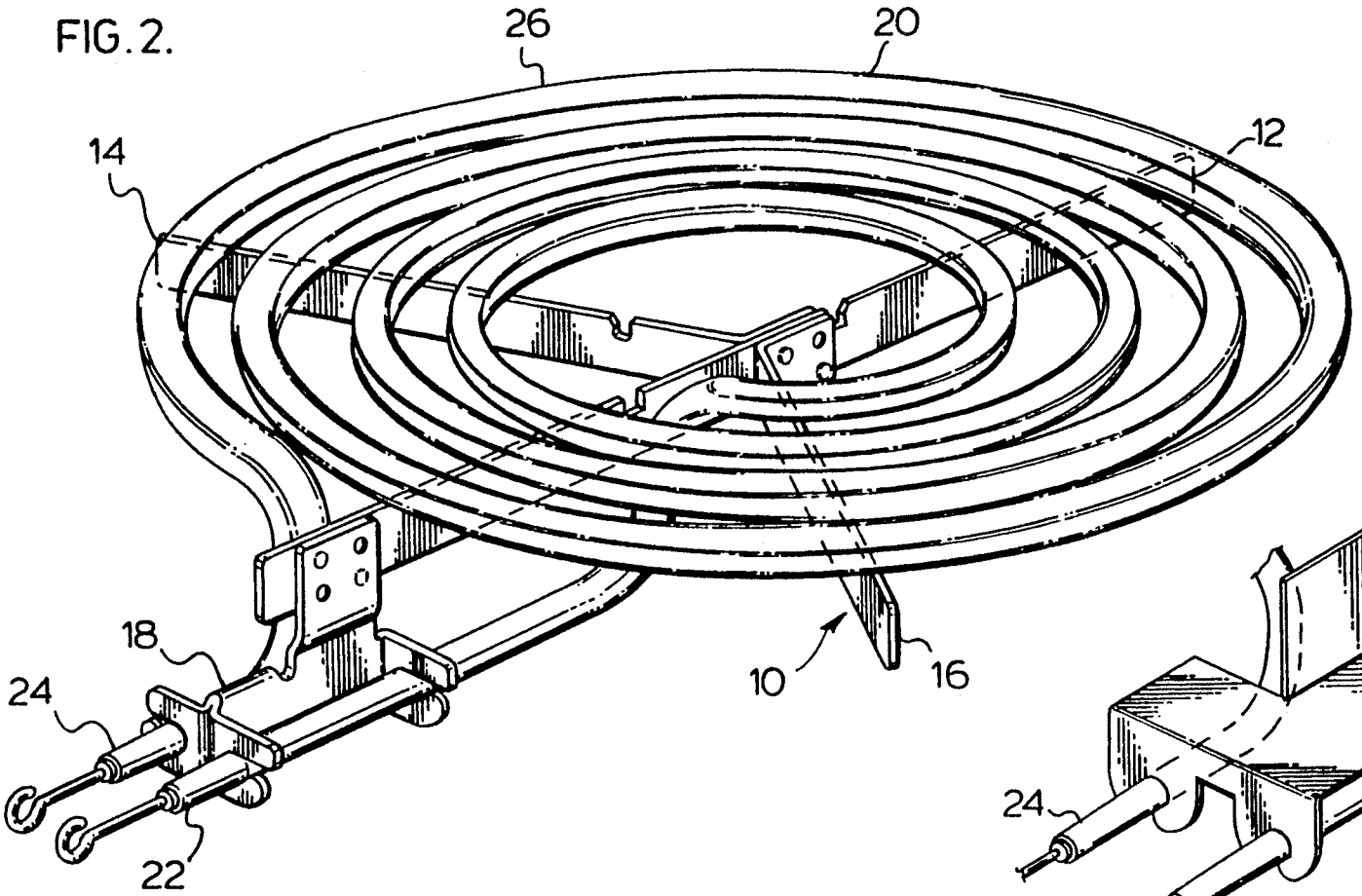
FIG. 2 is a perspective view of the preferred embodiment of the present invention.

The invention is generally illustrated in FIG. 2. The spider bracket 10 generally comprises a main rib 12 and having side ribs 14 and 16 extending from the middle of main rib 12. Extending at one end of main rib 12 is crimp bracket 18.

Resting on top of the ribs 12, 14 and 16, is heating element 20. Heating element 20 has a first end section 22 and a second end section 24. Intermediate the two ends is a coiled section 26. Ends 22 and 24 extend downwardly from the coiled section 26 and then outwardly, substantially parallel to each other as illustrated in FIG. 2. Since end 22 extends from the centre or inner portion of the coil and end 24 from the outer radius of the coil, end 22 is longer than end 24.

As illustrated in FIG. 3, ribs 14 and 16 have one end thereof which is bent at an obtuse angle for presenting to the main rib 12. Main rib 12 is provided with a pair of offset lugs 28 extending from each side of the main rib 12. Diametrically opposed to lugs 28 are apertures 30 extending transversely through rib 12.

On the inner face of rib 14 and 16 are lugs 32 and apertures 34. Lugs 32 align with apertures 30 on main rib 12. Lugs 28 align with apertures 34 on ribs 14 and 16. As is apparent, the lugs 32 are presented to the apertures 30 which will align the ribs in the desired location to present a substantially planar surface defined by the upper edge of ribs 12, 14 and 16. The head of lug 28 will extend partially through the aperture 34. The remainder of the aperture 34 can be spot welded to form an integral unit.

Crimp bracket 18 is likewise provided with lugs 32 and apertures 34. One end of main rib 12 are corresponding lugs 28 and apertures 30. In a similar fashion, crimp bracket 18 is presented to the end of main rib 12 and spot welded to form an integral unit.

Crimp bracket 18 comprises a substantially L-shaped body 36. The lower portion of body 36 extends substantially co-planar with main rib 12. At each end of the lower portion of body 36 and extending substantially perpendicular thereto are crimp members 38 and 40. Extending at the outer most end of lower body 36 and substantially perpendicular to the body in a direction opposite crimp arm 40 is crimp member 42. Crimp members 38, 40 and 42 comprise an upper guide arm 44, 46 and 48, respectively and a lower crimping arm 50, 52 and 54, respectively.

Figure 5:
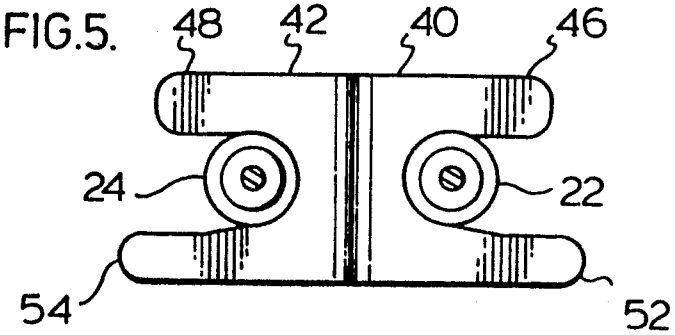
FIG. 5 is an end view of the crimp bracket and ends of a heating element of the embodiment of FIG. 2.
Figure 8:
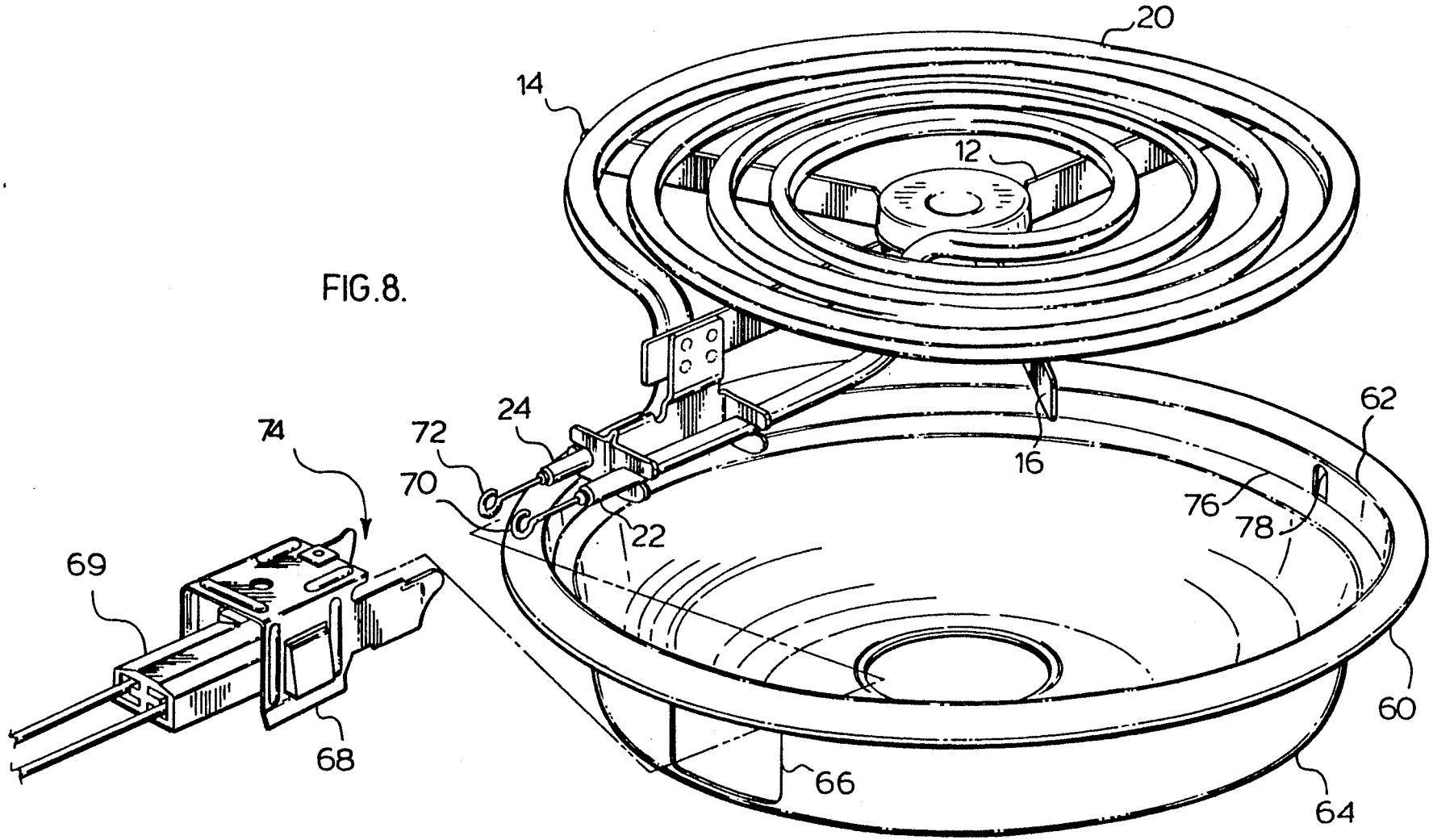
FIG. 8 is a perspective exploded view of the bracket of the embodiment of FIG. 2 as a completed sub-assembly for installation.

As illustrated in FIG. 5, crimp member 40 has an upper guide arm 46 and a lower crimping arm 52 presenting a U-shape seat therebetween for receiving end 22 and end 24, respectively, of heating element 20.

Figure 6:
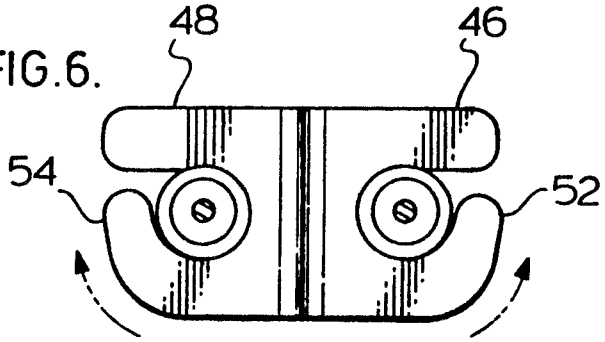
FIG. 6 is an end view of the crimp bracket and ends of a heating element of the embodiment of FIG. 2 with the crimp arms crimped about the ends of the element.

As illustrated in FIG. 6, lower crimping arms 52 and 54 are malleable to be crimped about the end 22 and end 24 of heating element 20. To fully secure the ends of the heating element substantially parallel to each other. Equally, lower arm 50 is malleable as well to secure end 22 of heating element 20.

It will be noted that the dimensions of lower arm 50, 52 and 54 are such that when fully crimped about the ends 52 and 24 of heating element 20, upper guide arms 44, 46 and 48 will extend outwardly beyond the crimped lower arm 50, 52 and 54. Therefore, the relative lengths of upper guide arms 44, 46 and 48 can be configured to any suitable size. In particular, the upper guide arms 44, 46 and 48 can be configured to act as a lateral guide for further subassembly, as discussed below.

As is apparent, crimp bracket 18 may be stamped from a sheet of metal and bent to the desired shape. Lugs 32 may be formed from a stamping process or alternatively be separate lug pieces and spot welded together.

To prepare a sub-assembly as illustrated in FIG. 2, the heating element 20 is presented to the ribs 12, 14 and 16 until it rests flush on the surface. End 22 of element 20 is aligned to rest in the U-shaped seat of crimp arm 38 and 40. End 24 is aligned to rest in the U-shaped seat of crimp arm 42. In this position, the heating element fully rests upon and contacts with ribs 12, 14 and 16. The lower arms 50, 52 and 54 are crimped about the ends 22 and 24 of element 20 until it is fully secured in the crimp bracket. Since only one arm of the crimping arms is crimped about the end of the element, there is only a small likelihood that the alignment of the ends of the heating element would be affected by the crimping action. The ends of the element remain substantially parallel to each other and substantially in the same orientation as prior to the crimp. In this manner, the heating element remains fully flush with the rib 12, 14 and 16.

Figure 7:
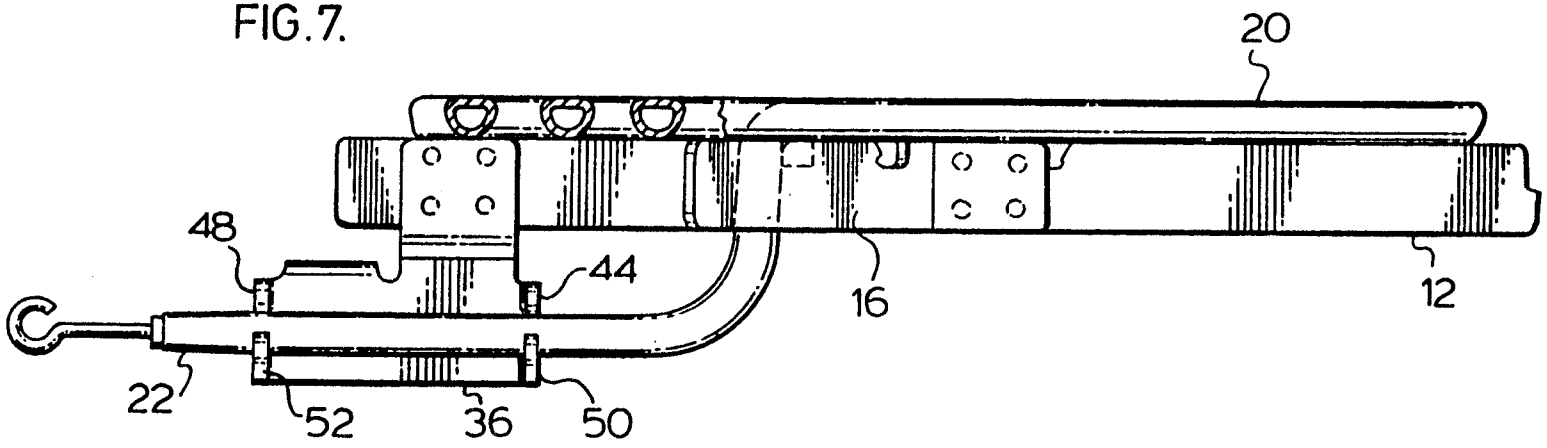
FIG. 7 is a side elevational view of the embodiment of FIG. 2.

To prepare a further sub-assembly as illustrated in FIG. 7, the heating element 20 which is now in a sub-assembly form as illustrated in FIG. 2 is presented to stove pan 60.

Stove pan 60 can be either a two piece version or a one piece version. In the two piece version, the ring 62 is separate from the base 64 for catching material which falls between the element. Base 64 has a square opening 66 adapted to receive a mousetrap 68. Mousetrap receptacle 68 is mounted to the frame of the stove appliance and has electrical connections and a receptacle 69 for receiving looped ends 70 and 72 of the element 20. Most stove appliances will have a standard sized mousetrap with known dimensions at the mouth 74 of the mousetrap 68. Also, the receptacle 69 will also be standard having a known dimension for receiving the looped ends 70 and 72. Pan 60 is mounted over a circular opening in the upper surface of the stove appliance with the mousetrap extending through the opening 66.

The guide arms 44, 46 and 48 are dimensioned such that the combined width of the crimp bracket is substantially the same distance as the distance across mouth 74 of mousetrap 68 for a frictional fit. The guide arms act to maintain the looped ends 70 and 72 positioned to enter the receptacle 69.

Element 20 is presented at an angle to the mousetrap 68 inserting the looped ends 70 and 72 into receptacle 69 until fully interlocked therein. The element will swing downwardly until arms 12, 14 and 16 rest on ledge 76 of pan 60. Diametrically opposed to opening 66 and above the ledge 74 is a narrow rectangular opening 78 for positioning the end of arm 12.

While various changes may be made in detail or constructions, it shall be understood that such changes shall be within the spirit and the scope of the present invention.

I claim:

1. A spider bracket for retaining an electrical heater element as a sub-assembly, said heater element comprising a coiled section presenting an upper and lower planar surface and having two ends thereof extending substantially parallel to each other adapted for further sub-assembly, said bracket comprising a plurality of arms defining a planar surface and adapted to abut with said element, a crimp bracket extending from said arms, said crimp bracket having a plate extending substantially perpendicular to said planar surface and having a plurality of crimp members extending substantially perpendicular to said plate in opposite directions, said crimp members having a substantially U-shape for receiving said ends of said element, each said crimp member having a crimp arm and a guide arm defining said U-shape, whereby upon presenting said lower planar surface of said element to said arms and the ends of said element to the crimp member, crimping the crimp arm about the ends of said heater element, said planar surface of said arms is substantially co-planar with said lower surface of said element.

2. A spider bracket as claimed in claim 1 wherein said guide arms are configured to frictionally engage a mouth of a mousetrap receptacle for guiding said ends of said element into said receptacle for electrical connection.

3. A spider bracket as claimed in claim 2 wherein said bracket has three crimp members, two extending from one side of said plate and one crimp member extending from an opposite side of said plate, said heater element being coiled and having one end extending from an inner portion of the coil and an opposite end extending from an outer portion of the coil, said two crimp members retaining said one end of said heater element and said one crimp member retaining said opposite end.

4. A spider bracket as claimed in claim 3 wherein said two crimp members extend substantially perpendicular to said plate from opposite ends of said plate and said one crimp member extends substantially perpendicular to said plate from an outer end of said plate.

5. A spider bracket as claimed in claim 4 wherein said crimp bracket is stamped from a single sheet of metal and bent to the desired configuration.

* * * * *